US010188923B2

(12) United States Patent
Cartagena, Jr. et al.

(10) Patent No.: US 10,188,923 B2
(45) Date of Patent: Jan. 29, 2019

(54) ATHLETIC TRAINING TOOL

(71) Applicant: BODY ARTS GYM, LLC, Philadelphia, PA (US)

(72) Inventors: Angel L. Cartagena, Jr., Voorhees, NJ (US); Anna Khara Cartagena, Voorhees, NJ (US); Alex Z. Clendenon, Voorhees, NJ (US)

(73) Assignee: BODY ARTS GYM, LLC, Philadelphia, PA (US)

( * ) Notice: Subject to any disclaimer, the term of this patent is extended or adjusted under 35 U.S.C. 154(b) by 259 days.

(21) Appl. No.: 14/812,635

(22) Filed: Jul. 29, 2015

(65) Prior Publication Data

US 2016/0030822 A1 Feb. 4, 2016

Related U.S. Application Data

(60) Provisional application No. 62/030,472, filed on Jul. 29, 2014.

(51) Int. Cl.

| | |
|---|---|
| ***A63B 69/00*** | (2006.01) |
| ***A63B 69/36*** | (2006.01) |
| *A63B 71/08* | (2006.01) |
| *A63B 102/32* | (2015.01) |

(52) U.S. Cl.

CPC ..... *A63B 69/0002* (2013.01); *A63B 69/0059* (2013.01); *A63B 69/36* (2013.01); *A63B 71/085* (2013.01); *A63B 2069/0008* (2013.01); *A63B 2102/32* (2015.10)

(58) Field of Classification Search

CPC ..... A63B 69/0002; A63B 69/0059; A63B 71/085; A63B 69/36; A63B 69/3623; A63B 69/0057; A63B 69/36; A63B 2102/32; A63B 2069/0008

USPC ..... 473/422, 450, 458, 464, 451, 208, 211, 473/207, 247, 438, 252; D29/108; 128/861

See application file for complete search history.

(56) References Cited

U.S. PATENT DOCUMENTS

| | | | | |
|---|---|---|---|---|
| 1,126,051 A | | 1/1915 | McGillicuddy | |
| 2,461,826 A | * | 2/1949 | Krautter | A63B 69/3608 473/208 |
| 2,694,397 A | * | 11/1954 | Herms | A61B 1/24 128/861 |
| 3,059,932 A | | 10/1962 | Smallwood | |
| 3,407,809 A | * | 10/1968 | Ross | A63B 71/085 128/861 |
| 3,682,164 A | * | 8/1972 | Miller | A63B 71/085 128/861 |
| 3,860,246 A | * | 1/1975 | Fish | A63B 69/3608 473/210 |
| 5,174,564 A | * | 12/1992 | Young, III | A63B 69/0059 473/458 |
| 5,234,005 A | * | 8/1993 | Kittelsen | A63B 71/085 128/859 |
| 5,651,680 A | | 7/1997 | Levy | |
| 5,746,663 A | * | 5/1998 | Calace | A63B 69/0002 473/458 |

(Continued)

*Primary Examiner* — Mitra Aryanpour

(74) *Attorney, Agent, or Firm* — Volpe and Koenig, P.C.

(57) ABSTRACT

An athletic training tool that improves swinging performance by helping players maintain proper form. The tool discourages the user from raising their shoulders. The tool provides a comfortable, sanitary, and performance enhancing bite piece directly attached to the users' shirt/apparel.

10 Claims, 10 Drawing Sheets

(56) References Cited

U.S. PATENT DOCUMENTS

| | | | | |
|---|---|---|---|---|
| 5,976,037 | A | 11/1999 | Watson | |
| 6,332,846 | B1 * | 12/2001 | Rennhack | A63B 69/3608 473/208 |
| 7,708,018 | B1 * | 5/2010 | Hirshberg | A63B 71/085 128/861 |
| 8,074,658 | B2 * | 12/2011 | Kittelsen | A63B 71/085 128/859 |
| 8,808,103 | B2 * | 8/2014 | Hart | A63B 69/0057 473/212 |
| D734,556 | S * | 7/2015 | Brett | D24/181 |
| 2016/0030822 | A1 * | 2/2016 | Cartagena, Jr. | A63B 69/36 473/458 |

* cited by examiner

Embodiment A

Embodiment B

Embodiment C

Embodiment D

Embodiment E

Embodiment F

Embodiment G

Embodiment H

Embodiment I

ATHLETIC TRAINING TOOL

CROSS REFERENCE TO RELATED APPLICATION

This application claims the benefit of U.S. Provisional Patent Application No. 62/030,472 filed on Jul. 29, 2014, which is incorporated by reference as if fully set forth.

FIELD OF INVENTION

The present application generally relates to the field of athletic training.

BACKGROUND

Many athletes exhibit improved swinging performance when biting their shirt/apparel to steady their head in an improved position. There are many different types of training devices for improving an athlete's technique. These devices range from modified hitting instruments to specialized clothing. For sports in which swinging is required, for example baseball or golf, athletes frequently demonstrate a technical issue by lifting their head out of the proper positioning mid-swing. Lifting the head has a severe impact on athletes' performance as it can cause other issues such as lifting of the hands and the athlete opening up too early on their swing.

U.S. Pat. No. 1,126,051 to McGillicuddy illustrates a device to correct the head position of golf players. The McGillicuddy device utilizes a mouthpiece attached to an elastic strap which is connected to a belt that wraps around the user's chest. This configuration does not hold the athlete's head in an optimum position and does not allow for optimum sight of a target. Further, the elastic strap and belt are cumbersome and awkward, making the athlete less comfortable and more distracted.

U.S. Pat. No. 5,651,680 to Levy describes a device containing a mouthpiece connected to a fastening assembly by a cord. The fastening assembly is meant to be attached to the athlete's shirt/apparel. This assembly does not keep the athlete's head in an optimum position. The Levy device is also cumbersome and could impact the speed and momentum of the athlete's swing.

U.S. Pat. No. 5,976,037 to Watson describes a device which uses a spring loaded clamping mechanism that attaches to the athlete's shirt/apparel. Attached to the clamp is a cord which has a mouth piece secured on the first end and the clamp attached on the second end. This device, when used as intended, is attached just above the user's leading pectoral muscle. This places the user's head in a position which encourages the user to have only one eye turned towards the target or any balls being thrown in the user's direction. This position negatively impacts the user's vision and inhibits the user's swing. Additionally, the Watson device uses tension from the attached cord to shape the athlete's swing and keep the athlete from moving his head out of position, which does not promote any kind of active learning.

In general, previous inventions which aid in correcting the head position of athletes do not allow for the athlete to maintain optimum sight of the target and have been cumbersome, distracting, and interfere with the momentum of the athlete's swing. Accordingly, there is a need for a device that helps the athlete improve sight by enabling the athlete to maintain view of the ball by keeping both eyes facing toward the target. Further, there is a need to for the device to be neither cumbersome nor distracting for an athlete to wear and use.

SUMMARY

An athletic training device to teach an athlete to maintain proper head position throughout a swinging motion is disclosed herein. The athletic training device helps teach an athlete the proper head position for an optimal swing while aiding the athlete in maintaining sight of the ball. In an embodiment, one end of the device is slid over a pinched portion of the athlete's shirt/apparel and the athlete bites on the other end of the device to place the athlete's head in an optimal position for swinging. An athlete, for example a baseball player or golfer, may utilize the proposed invention by holding on to the mouthpiece with his teeth while swinging in order to keep his head from moving excessively.

An additional benefit of the athlete biting the mouth piece is the biting helps maintain the grip of the device on the shirt/apparel of the athlete. If the athlete moves his head into an undesirable position or swings improperly, the device will become detached from the athlete's shirt/apparel indicating that the athlete has made an inferior movement.

BRIEF DESCRIPTION OF THE DRAWINGS

The proposed invention can be better understood with reference to the drawings shown. The drawings do not depict the exact form or scale of the invention, but focus on concept and function, which are demonstrated in multiple embodiments.

Embodiment A is illustrated in FIGS. 1-4.

Embodiment H is illustrated in FIGS. 29-32.

Figure 1:
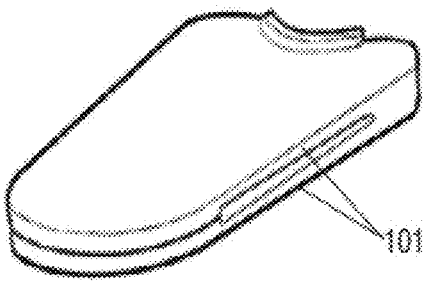
FIG. 1 is a perspective view of Embodiment A.
Figure 2:
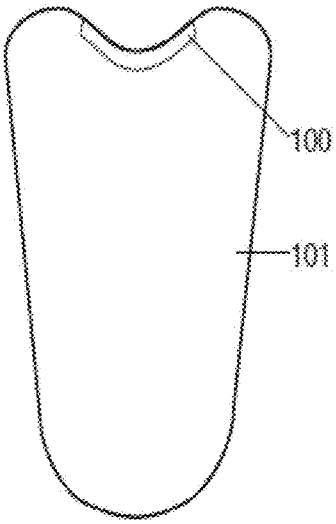
FIG. 2 is a top view of Embodiment A.
Figure 3:
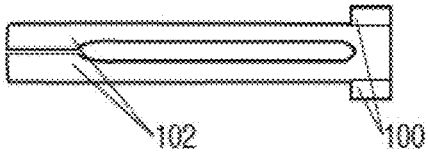
FIG. 3 is a front view of Embodiment A.
Figure 4:
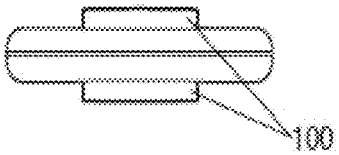
FIG. 4 is a side view of Embodiment A.
Embodiment B is illustrated in FIGS. 5-8.
Figure 5:
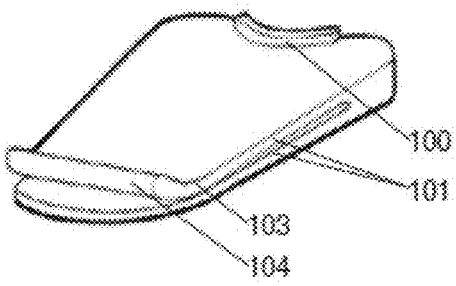
FIG. 5 is a perspective view of Embodiment B.
Figure 6:
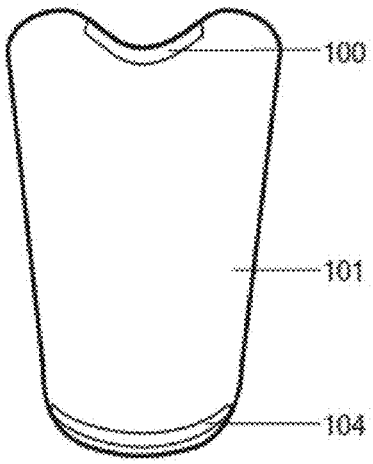
FIG. 6 is a top view of Embodiment B.
Figure 7:
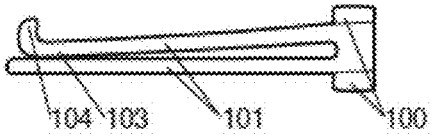
FIG. 7 is a front view of Embodiment B.
Figure 8:
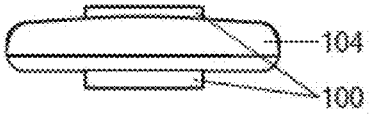
FIG. 8 is a side view of Embodiment B.
Embodiment C is illustrated in FIGS. 9-12.
Figure 9:
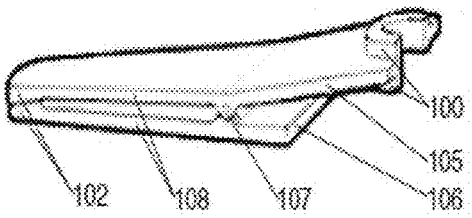
FIG. 9 is a perspective view of Embodiment C.
Figure 10:
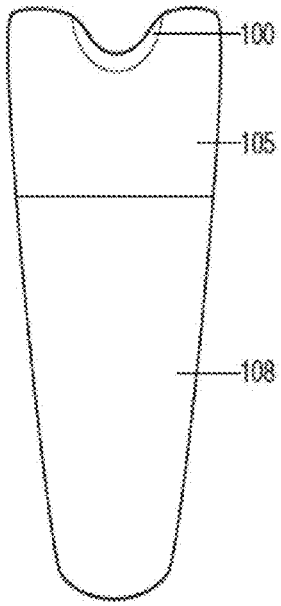
FIG. 10 is a top view of Embodiment C.
Figure 11:
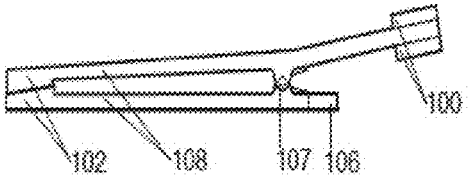
FIG. 11 is a front view of Embodiment C.
Figure 12:
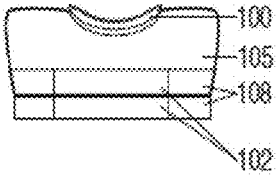
FIG. 12 is a side view of Embodiment C.
Embodiment D is illustrated in FIGS. 13-16.
Figure 13:
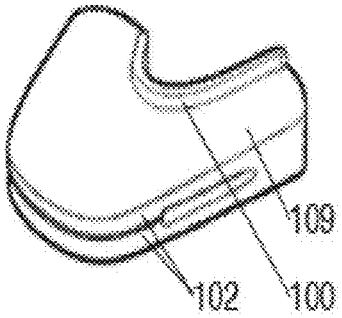
FIG. 13 is a perspective view of Embodiment D.
Figure 14:
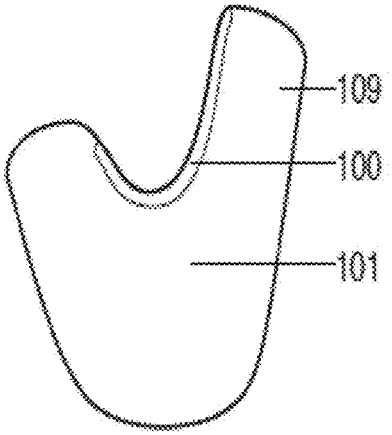
FIG. 14 is a top view of Embodiment D.
Figure 15:
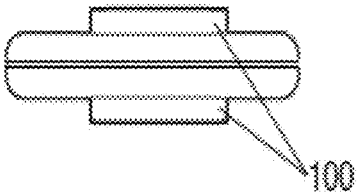
FIG. 15 is a front view of Embodiment D.
Figure 16:
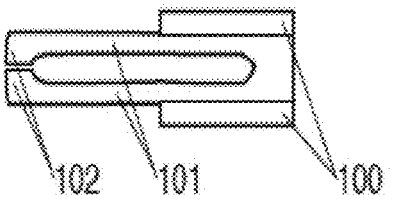
FIG. 16 is a side view of Embodiment D.
Embodiment E is illustrated in FIGS. 17-20.
Figure 17:
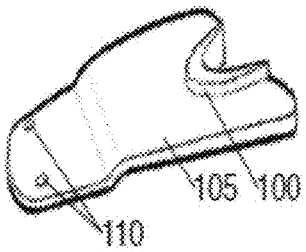
FIG. 17 is a perspective view of Embodiment E.
Figure 18:
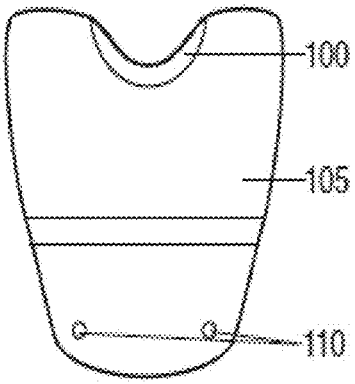
FIG. 18 is a top view of Embodiment E.
Figure 19:
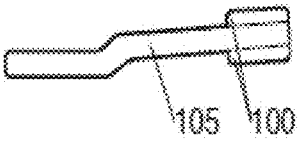
FIG. 19 is a front view of Embodiment E.
Figure 20:
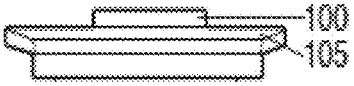
FIG. 20 is a side view of Embodiment E.
Embodiment F is illustrated in FIGS. 21-24.
Figure 21:
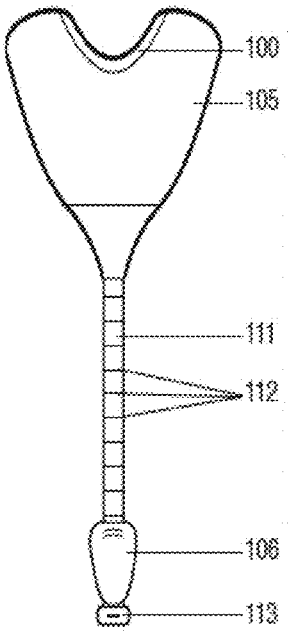
FIG. 21 is a perspective view of Embodiment F.
Figure 22:
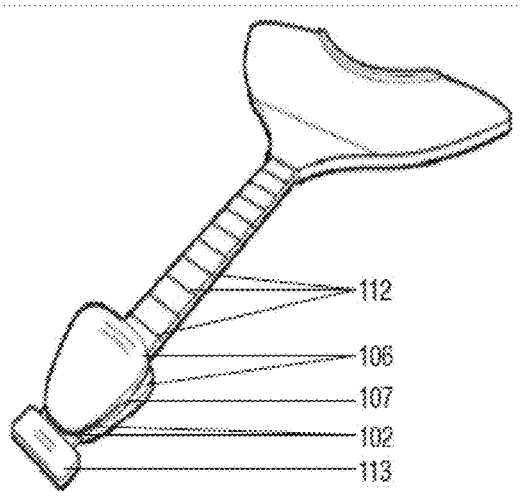
FIG. 22 is a top view of Embodiment F.
Figure 23:
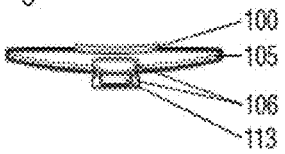
FIG. 23 is a front view of Embodiment F.
Figure 24:
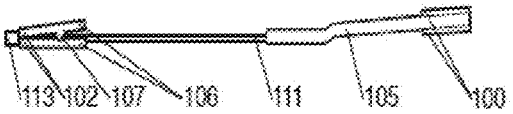
FIG. 24 is a side view of Embodiment F.
Embodiment G is illustrated in FIGS. 25-28.
Figure 25:
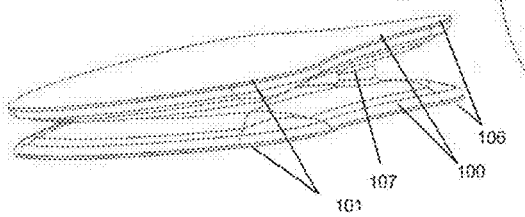
FIG. 25 is a perspective view of Embodiment G.
Figure 26:
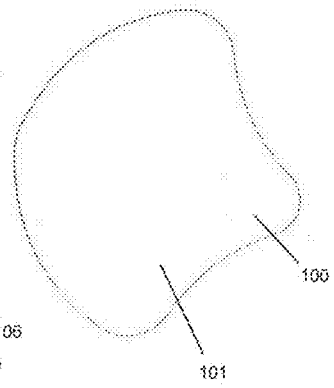
FIG. 26 is a top view of Embodiment G.
Figure 27:
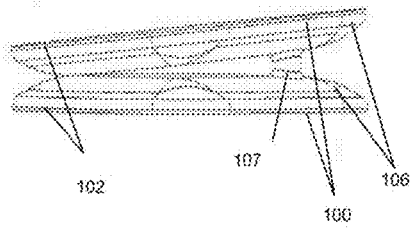
FIG. 27 is a front view of Embodiment G.
Figure 28:
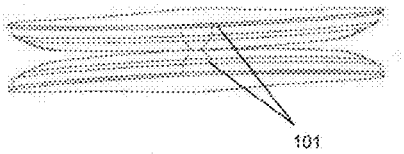
FIG. 28 is a side view of Embodiment G.
Figure 29:
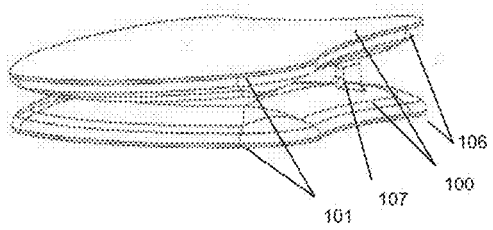

FIG. 29 is a perspective view of Embodiment H.

Figure 30:
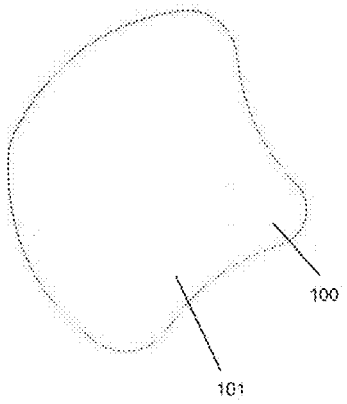

FIG. 30 is a top view of Embodiment H.

Figure 31:
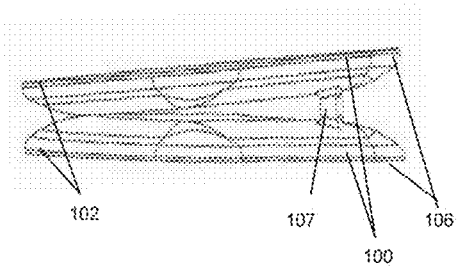

FIG. 31 is a front view of Embodiment H.

Figure 32:
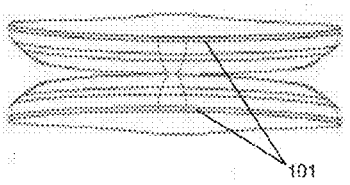

FIG. 32 is a side view of Embodiment H.

Embodiment I is illustrated in FIGS. 33-36.

Figure 33:
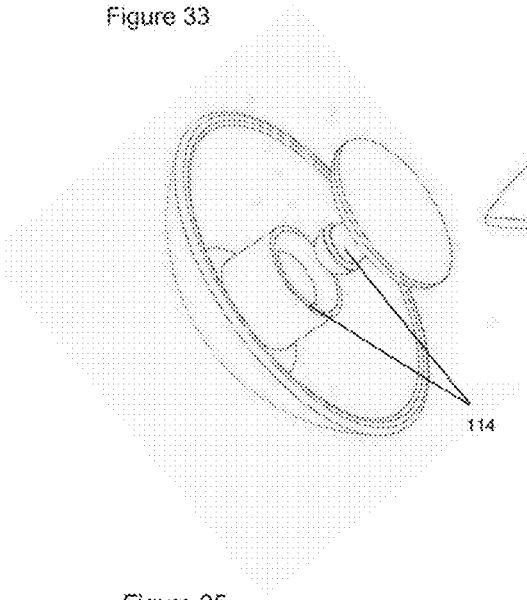

FIG. 33 is a perspective view of Embodiment I.

Figure 34:
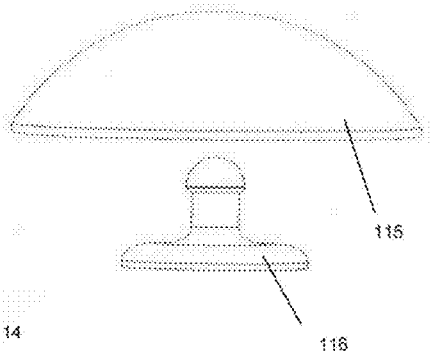

FIG. 34 is a top view of Embodiment I.

Figure 35:
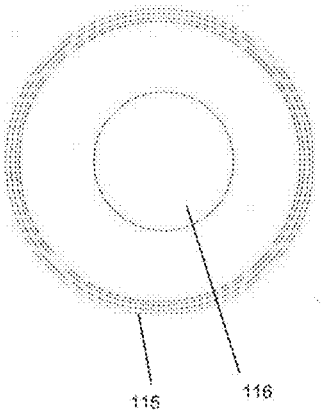

FIG. 35 is a front view of Embodiment I.

Figure 36:
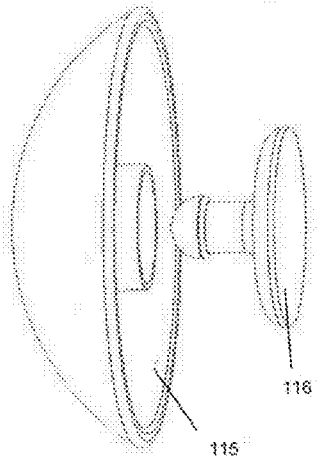

FIG. 36 is a side view of Embodiment I.

Figure 37:
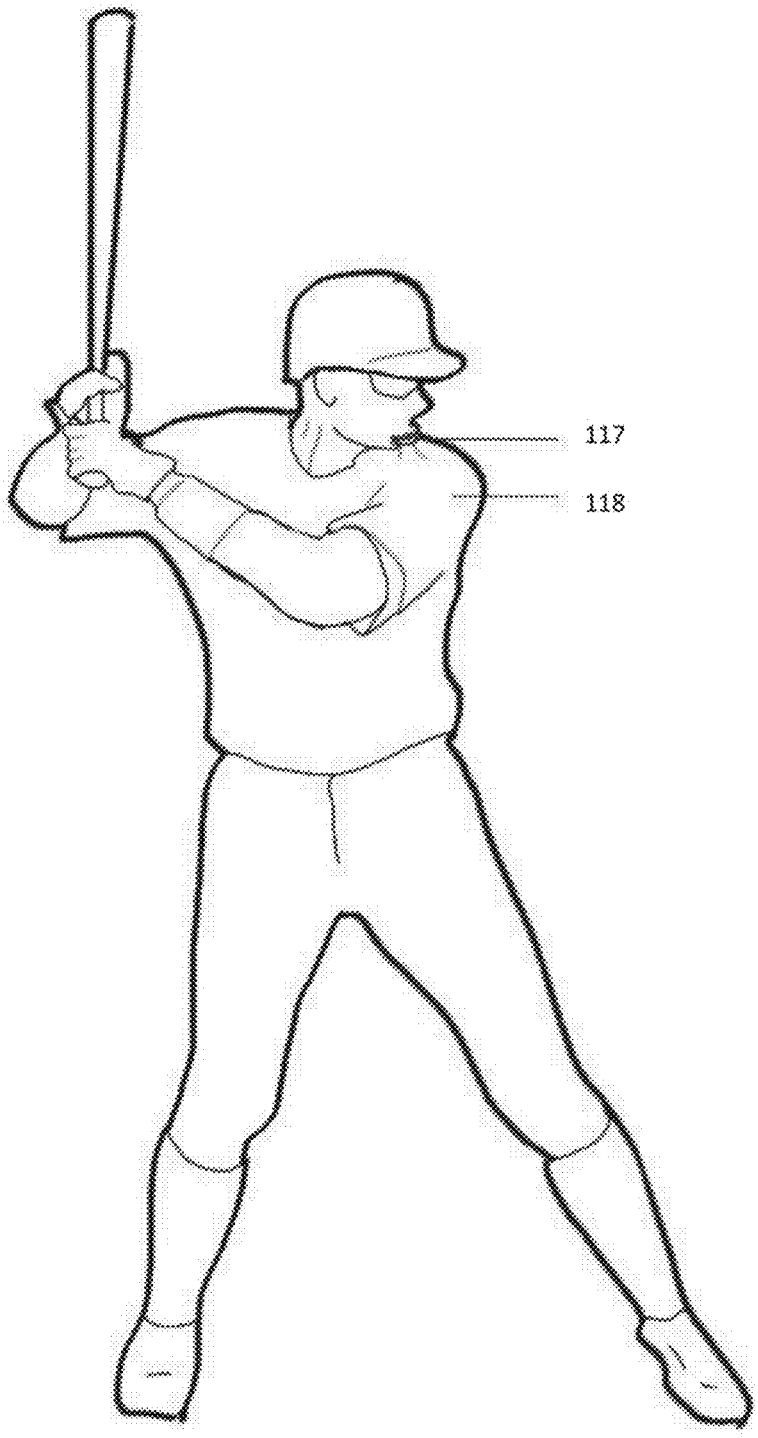

FIG. 37 is a depiction of one embodiment of the athletic training tool in use for example by a baseball batter.

DETAILED DESCRIPTION

FIGS. 1-37 depict various non-limiting embodiments, Embodiments A-I, of an athletic device to teach athletes to maintain proper head positioning during their swing. All embodiments of the device provide a way to improve muscle memory while improving swing by training the muscles to be in the correct position. All embodiments of the device will discourage athletes from moving their heads both in the load and through the completion of the swing. All embodiments of the device are designed to aid an athlete in maintaining proper head position and eliminating undesirable head movement while swinging by biting a mouth piece that may be attached to the athlete's shirt/apparel.

Embodiments A-E and G-I of the device are small and portable, for example no more than 4 inches long. Embodiment F of the device would be slightly longer, for example no longer than 7 inches, to allow more room and adjustability for athletes playing sports that require it, for example golf.

Some of the embodiments of the device depicted contain a bite guard 100, which is a raised edge that extends perpendicular to a mouth piece 101/105. The bite guard 100 is designed to enable the user to better grip the device with their teeth by having a barrier against the back of his teeth. All embodiments of the device may attach to any section of a user's shirt/apparel 118 that most benefits the user's swing, for example a pinched section of the user's shirt/apparel 118 near the leading shoulder.

Embodiment A is illustrated in FIGS. 1-4. The device depicted by Embodiment A contains a mouth piece 101, comprising a bite guard 100 on which a user bites, and top and bottom portions of a clip opening 102 to clip onto the user's shirt/apparel.

Embodiment B is illustrated in FIGS. 5-8. The device depicted by Embodiment B functions similarly to a money clip, and therefore contains a mouth piece 101, comprising a bite guard 100 on which a user bites, and a top and bottom portion of a clip opening 103, which slides over a pinched section of material or collar. Embodiment B presents the added benefit of a second bite option 104.

Embodiment C is illustrated in FIGS. 9-12. The device depicted by Embodiment C functions similarly to a clam-shell-like open-and-close action, and therefore contains a mouth piece 105 and an elongated clip portion 108 that clips over a user's clothing; using, for example, a spring-loaded clip 107. The mouth piece 105 consists of a bite guard 100 on which the user bites. The elongated clip portion 108 consists of top and bottom portions of a clip opening 102 and a bottom piece containing a grasp 106 that allows a user to easily utilize the open-and-close function of the clip. The elongated clip portion 108 provides attachment for special apparel, for example collared shirts. The mouthpiece 105 extends beyond the elongated clip portion 108 of the device.

Embodiment D is illustrated in FIGS. 13-16. The device depicted by Embodiment D contains a mouth piece 101, comprising a bite guard 100 on which a user bites, and top and bottom portions of a clip opening 102 to clip onto the user's shirt/apparel. Embodiment D, however, provides a more fitted bite option 109 by extending to contour along one side of the mouth.

Embodiment E is illustrated in FIGS. 17-20. The device depicted by Embodiment E contains a mouth piece 105, comprising a bite guard 100 on which a user bites, and an attachment site 110. The attachment site 110 may be, for example, two holes that may be used to semi permanently attach the device to the user's apparel by sewing it on.

Embodiment F is illustrated in FIGS. 21-24. The device depicted by Embodiment F contains a mouth piece 105 comprising a bite guard 100 on which a user bites, a strip 111, and a grasp 106 attached to, for example, a spring-loaded clip 107. The strip 111 is attached at one end to the mouth piece 105 and to a grip 113 at the opposite end. The strip 111 runs through the grasp 106, and may be pulled by the grip 113 to move through the grasp 106 to a desired length. The strip 111 contains multiple divots 112, which maintain the desired length when clicked in place inside the grasp 106. Embodiment F of the device is designed for a swinging sport that requires a training device with more length options, for example golf.

Embodiment G is illustrated in FIGS. 25-28. The device depicted by Embodiment G contains a mouth piece 101, comprising a bite guard 100 on which a user bites, top and bottom portions of a clip opening 102 to clip onto a user's shirt/apparel, and a grasp 106 that allows a user to easily utilize the open-and-close function of the clip by using, for example, a spring-loaded clip 107.

Embodiment G is illustrated in FIGS. 29-32. The device depicted by Embodiment H contains a mouth piece 101, comprising a bite guard 100 on which a user bites, top and bottom portions of a clip opening 102 to clip onto a user's shirt/apparel, and a grasp 106 that allows a user to easily utilize the open-and-close function of the clip by using, for example, a spring-loaded clip 107.

Embodiment I is illustrated in FIGS. 33-36. The device depicted by Embodiment I contains a detachable mouth piece 114, comprising a detachable bite guard 115 on which a user bites, and a detachable clip 116 to clip onto a user's shirt/apparel. The detachable bite guard 115 is attached to the outside of the shirt at either the left or right breast to the detachable clip 116 located on the inside of the shirt. Embodiment I of the device is designed for a swinging sport that requires a training device with more attachment options; for example, baseball.

FIG. 37 is a depiction of one embodiment of the athletic training tool 117 attached to a user's shirt/apparel 118 for use by, for example, a baseball batter. The head positioning that is encouraged by this device as depicted in FIG. 37 will help the user with tracking the ball as proper head position may aid the user's vision.

In one embodiment, the opening 102/103 has raised portions, for example on the inside of the body of the device. The raised portions of the opening 102 function to improve the device's grip on the user's shirt/apparel 118. It is understood by those familiar with the art that these raised portions can, for example, take the form of teeth, a texture, or the bumps that run across the surface as shown.

It is understood by those familiar with the art that this device may come in different sizes for use by athletes of all sizes and be easy to use such that it can attach to a user's apparel and be used to improve the user's swing without interfering with other aspects of the user's swing. It is understood by those familiar with the art that the device may be attached to any part of the user's apparel and may attach to any form of apparel, for example a sweatshirt, jersey, or other athletic apparel.

What is claimed is:

1. An athletic training device for training a user to maintain proper swinging position, the device comprising:

a mouth piece having symmetric top part and bottom part configured in a spring loaded clam-shell-like clip arrangement;

wherein said top part and bottom part each include:

a grasp portion, a bite guard portion, and a clip opening portion;

wherein the top and bottom grasp portions are separated by a spring that provides a preloaded closing force on the top and bottom opening portions in order to attach the mouth piece onto he collar or breast portion of a user's shirt;

wherein the top and bottom bite guard portions are each shaped to allow the user to bite while swinging athletic equipment and maintain proper head position; and wherein the grasp portion is configured to allow the user to easily open and close the opening portions using their fingers or mouth.

2. The athletic training device of claim 1, wherein the bite guard portion of the mouth piece is configured to keep the device in place when the user bites.

3. The athletic training device of claim 1, wherein the bite guard portion has a raised edge configured to rest against the teeth of the user to provide the user with better grip on the device.

4. The athletic training device of claim 1, wherein the clip opening portion has raised portions on the surface of the inside of the top and bottom portions to secure a user's shirt/apparel.

5. The athletic training device of claim 1, wherein the clip opening portion is configured to slide over a pinched section of a user's shirt/apparel.

6. The athletic training device of claim 1, wherein the bite guard portion is configured to provide mouth protection through shock absorption.

7. The athletic training device of claim 1, wherein the mouth piece is comprised of a polymer that does not support microbial growth.

8. An athletic training device for training a user to maintain proper head position while swinging, the device comprising;

a detachable mouth piece including:

a female detachable bite guard that is a spherical dome shape having a top portion that is configured for a user to bite on, and a bottom portion;

a male detachable clip configured to lockingly engage with the bottom portion of the female detachable bite guard through the user's shirt or apparel;

wherein the detachable mouth piece is configured to clip directly onto the left or right collar or breast portion of the user's shirt/apparel;

wherein the male detachable clip is configured to reside on the inside of the user's shirt/apparel and lockingly engage the female detachable bite guard on the outside of the user's shirt/apparel;

wherein the female detachable bite guard is sized to allow the user to comfortably bite while swinging athletic equipment and maintain proper head position; and wherein the male detachable clip coupling includes a flat back portion configured to rest against the user's skin or undershirt.

9. The athletic training device of clam 8, wherein the male detachable clip includes a bulbous end configured to lockingly engage the female detachable bite guard.

10. The athletic training device of claim 8, wherein the mouth piece is comprised of a polymer that does not support microbial growth.

* * * * *